US008303308B2

(12) United States Patent
Linderö

(10) Patent No.: US 8,303,308 B2
(45) Date of Patent: Nov. 6, 2012

(54) METHOD AND SYSTEM FOR FIRE SIMULATION

(75) Inventor: Björn Linderö, Huskvarna (SE)

(73) Assignee: SAAB AB, Linköping (SE)

( * ) Notice: Subject to any disclaimer, the term of this patent is extended or adjusted under 35 U.S.C. 154(b) by 1160 days.

(21) Appl. No.: 11/885,192

(22) PCT Filed: Feb. 24, 2006

(86) PCT No.: PCT/EP2006/060258

§ 371 (c)(1),
(2), (4) Date: Jun. 3, 2008

(87) PCT Pub. No.: WO2006/089947

PCT Pub. Date: Aug. 31, 2006

(65) Prior Publication Data

US 2009/0035730 A1 Feb. 5, 2009

(30) Foreign Application Priority Data

Feb. 28, 2005 (EP) ..... 05004270

(51) Int. Cl.
*F41A 33/02* (2006.01)

(52) U.S. Cl. ..... 434/11; 434/21

(58) Field of Classification Search ..... 434/11, 434/22

See application file for complete search history.

(56) References Cited

U.S. PATENT DOCUMENTS 4,218,834 A 8/1980 Robertsson
4,478,581 A 10/1984 Goda
5,228,854 A * 7/1993 Eldridge ..... 434/11
5,378,155 A * 1/1995 Eldridge ..... 434/11
5,688,124 A * 11/1997 Salzeder ..... 434/11
6,283,756 B1 9/2001 Danckwerth et al.
6,386,879 B1 5/2002 Varshneya et al.
6,549,872 B2 4/2003 Bollweg et al.
7,275,691 B1 * 10/2007 Wright et al. ..... 235/404
2003/0224332 A1 * 12/2003 Trachuk ..... 434/11
2010/0261145 A1 * 10/2010 Isoz et al. ..... 434/11

FOREIGN PATENT DOCUMENTS

DE 3114000 A1 10/1982
WO WO-02/31429 A1 4/2002

OTHER PUBLICATIONS

PCT/ISA/210—International Search Report—Aug. 11, 2006.
PCT/ISA/237—Written Opinion of the Internatinal Searching Authority—Aug. 11, 2006.

* cited by examiner

*Primary Examiner* — Kang Hu
(74) *Attorney, Agent, or Firm* — Venable LLP; Eric J. Franklin

(57) ABSTRACT

A fire simulation method and system for simulating ammunition from a weapon. The method includes determining a trajectory of the simulated ammunition, emitting a light beam along a simulation axis, and coding said light beam with information. The method includes determining a point in time when the simulated ammunition passes a target, determining a value related to the distance between the simulation axis and a momentary position of the simulated ammunition along the trajectory at that point in time, and emitting the light beam coded with the determined value during a predetermined time period.

20 Claims, 5 Drawing Sheets

METHOD AND SYSTEM FOR FIRE SIMULATION

CROSS-REFERENCE TO RELATED APPLICATIONS

This application claims priority to European patent application 05004270.4 filed 28 Feb. 2005 and is the national phase under 35 U.S.C. §371 of PCT/EP2006/060258 filed 24 Feb. 2006.

The present invention relates to a fire simulation method for simulating ammunition from a weapon.

TECHNICAL AREA

The present invention further relates to a fire simulation system comprising a transmitter arranged to emit a light beam along a simulation axis to simulate ammunition from a weapon, coding means arranged to code the light beam with information, and processing means arranged to calculate a trajectory of a simulated ammunition. Ammunition refers to grenades, projectiles, missiles, rockets (i.e. projectiles with rocket engines), sector charges, etc.

STATE OF THE ART

When, in the same manner as during actual firing, a weapon is aimed at a target during fire simulation, it is necessary to determine the extent to which a live round fired using the alignment that the weapon has during the simulated firing would or would not hit the target. It is also desirable to be able to determine the hit location and the effect of the hit.

U.S. Pat. No. 4,218,834 describes a weapon simulation method based on a laser transmitter disposed on or near the weapon. The laser transmitter is arranged to emit laser radiation in the direction in which the weapon is pointed, and the targets are equipped with reflectors arranged so as to reflect the laser radiation back toward the weapon. Means disposed at the weapon to generate a projectile trajectory signal are started simultaneous with the firing of a simulated projectile. The projectile trajectory signal reproduces the continuously changing position of an imagined real projectile fired at the same moment as the simulated projectile, and contains a distance value calculated with reference to the weapon, plus calculated aiming values referenced to a predetermined axis pointing from the weapon in the direction of the projectile trajectory.

The laser radiation is caused to execute a sweeping movement in order to scan an area in front of the weapon, whereupon the radiation that is reflected from target reflectors located in front of the weapon is received. Signals are generated from the received radiation that contain a distance value based on a measurement of the time between the transmission and reception of the reflected radiation, which value is comparable with the calculated distance value, and aiming values corresponding to the current radiation, which aiming values are comparable with the calculated aiming values. The measured values are compared with the comparable calculated values in order to determine whether the real projectile would have hit the target. Selectivity in connection with the transmission of information to only one of a plurality of conceivable targets within the solid angle area swept by the sweeping movement is achieved in that the information is transmitted only for as long as reflected radiation is being received from each respective reflector. Selectivity with respect to receiving information is achieved in that certain conditions are set in order for received information to be accepted. Additional selectivity is achieved in that the foregoing valid information is transmitted only during those sweep periods that correspond to a correct distance having been attained in the ongoing projectile trajectory simulation. The foregoing conditions are described in detail in the weapon simulation method specified in U.S. Pat. No. 4,218,834.

U.S. Pat. No. 6,386,879 describes a weapon simulation system based on similar principles, but here the target is arranged so as to receive and assess received radiation. This system thus uses no reflectors. A GPS antenna is disposed in connection with the weapon, via which antenna position information for the weapon is received. Means for emitting laser radiation and for including information concerning the time the projectile was fired, the weapon identity, weapon type, projectile type, weapon angles of inclination and rotation, the geographical position and, if applicable, the speed of the weapon are also present in connection with the weapon. In the target there are means for detecting the laser radiation in order to determine azimuth and elevation data for the target, means for determining a range to the target by comparing the received GPS coordinates for the weapon with the GPS coordinates for the target as measured by means of a GPS received disposed in the target, and means for determining a hit location relative to the target for a ballistic projectile fired from the weapon at the time of firing as based on determined azimuth and elevation data for the target plus information included in the laser radiation.

Thus, simulation according to U.S. Pat. No. 6,386,879 is based on transmitting complete documentation in the form of the geographical position, speed and direction of the firing system at the instant of firing, the alignment of the weapon, etc., to the target after the instant of firing for subsequent processing in the target system. The target system itself calculates, based on the provided documentation, a hit location in relation to the target, including the entire movement of the target during the flight time of the ammunition. One of the disadvantages of the system according to U.S. Pat. No. 6,386,879 is that it does not permit any realistic simulation of ammunition that is guided by the gunner or observer/forward observer, wherein the trajectory of the ammunition can be corrected after firing.

DESCRIPTION OF THE INVENTION

One object of the present invention is to achieve a weapon simulation system that enables precision simulation of both ballistic and guided ammunition without the presence of reflectors.

This has been achieved according to one embodiment of the present invention by means of a fire simulation method for simulating ammunition from a weapon comprising the following steps:

- determining a trajectory of the simulated ammunition,
- emitting a light beam along a simulation axis, and
- coding said light beam with the information.

The fire simulation method is characterized by the following steps:

- determining a point in time when the simulated ammunition passes a target,
- determining a value related to the distance between the simulation axis and a momentary position of the simulated ammunition along the trajectory at the determined point in time and
- emitting the light beam coded with the determined value during a predetermined time period.

The weapon can be a live weapon or a replica of a live weapon. The weapon can, for instance, be person-borne or vehicle-borne. In yet another embodiment the weapon is virtual, and its entire existence is simulated by a fire simulation system at an observer/forward observer, or a command and control system.

The ammunition that is simulated consists of, e.g. grenades, projectiles, missiles, rockets (i.e. projectiles with rocket engines), mines, etc.

The step of determining trajectory of the simulated ammunition includes calculating the trajectory based on ammunition type. For ammunition with a ballistic trajectory, the azimuth and elevation of the weapon, the weight of the ammunition and the actual muzzle velocity of the weapon can be used in known manner to calculate the trajectory. In a case involving guided ammunition, the gunner or observer/forward observer can guide the ammunition. For example, the ammunition is guided continuously using a joystick, whereupon the positional status of the joystick is continuously used for updating the trajectory of the simulated ammunition. In an alternative case where the ammunition is guided toward the target automatically, the determination of the trajectory includes simulating an auto-seeking function In addition to the foregoing trajectory parameters (ballistic trajectory, manually guided trajectory, automatically guided trajectory), which are determined by the ammunition chosen and the weapon type, the trajectory is based on one or more predetermined parameters. These predetermined parameters include, e.g. timing ranges and variable time fuses on/off, which are set by the gunner, observer or command and control system. The trajectory can also be determined based on stochastic parameters, such as weather conditions. Furthermore, e.g. topographical conditions and other terrain conditions can be allowed to influence the trajectory.

One advantage with the method is that a light beam simulating ammunition is only emitted in the same moment as the ammunition passes or hits a target. Therefore batteries can be saved in the transmitters emitting the laser beams as the time of emission is substantially shortened. As the light beam is only emitted when the ammunition passes the target object, the risk of fighting targets not hit by the ammunition is practically eliminated. Further, as the emission is only activated when there is a possibility that a target has been hit, target systems receiving and evaluating the emitted light beam are less loaded with information about ammunition that does not affect the target.

In a preferred embodiment of the invention, the method further comprises the steps of determining the position of at least one potential target object, and directing the emitted light beam toward said target.

The step of determining the position of at least one potential target object includes in one embodiment determining the geographical positions of targets within a target area for the weapon. The target area can be determined by sensing the aiming of the weapon and calculating the area based on the geographical position of the weapon, the aiming of the weapon and the range of the weapon. The geographical position of the weapon and target/targets can be obtained by receiving position from a satellite based positioning system such as GPS.

The step of determining a point in time when the simulated ammunition passes the target includes in one embodiment of the invention determining a first distance between the weapon and each target object and comparing said first distance to a second distance to a momentary position of the simulated ammunition along the trajectory.

The light beam emitted is for example generated by laser. The laser can be working in the IR range or another frequency range. In one embodiment of the invention the emitted light beam is caused to execute a sweeping movement and for each direction of the sweep a new value related to the distance between the simulation axis and the momentary position of the ammunition along the trajectory is calculated and the determined new value is coded in the light beam.

The invention also comprises a system comprising a transmitter arranged to emit a light beam along a simulation axis to simulate ammunition from a weapon, coding means arranged to code the light beam with information, and processing means arranged to calculate a trajectory of simulated ammunition. The system is characterized in that the processing means further are arranged to determine a point in time when the simulated ammunition passes a target object and in that a control unit is arranged to activate the transmitter for a predetermined time period from said point in time and in that the control unit is arranged to determine a value related to the distance between the simulation axis and a momentary position of the simulated ammunition along the trajectory at the determined point in time and in that said coding means are arranged to code said light beam with the determined value.

Systems according to the present invention are, like U.S. Pat. No. 6,386,879, predicated on the target system itself assessing hit locations based on information received from firing systems. The present invention does enable this type of guidance, since the system is, as noted above, based on the fact that it is primarily the firing system that calculates and intermediates the ammunition trajectory. For example, weapons such as the Javelin, with which the gunner can switch targets during the flight of the ammunition by adjusting the trajectory with a joystick, can be simulated in a realistic manner by using the invention. Further, the system is suitable for both tactical training and firing range training.

In the absence of reflectors, the system according to the present invention thus offers simplified installation and a substantially more cost-effective system for larger targets. Installation on other targets, such as vehicles and soldiers, is of course also simplified because reflectors can be avoided. In terms of size, the detectors are generally smaller and lighter than reflectors. The absence of reflectors means that the detectors can be mounted with greater freedom, since they do not need to be positioned in immediate proximity to a reflector. The invention does however permit the presence of reflectors, as well as functionality as per U.S. Pat. No. 4,218,834 in parallel with functionality as per the present invention.

The fact that the transmitter is only activated during short time period when the simulated ammunition passes a potential target object decreases the power consumption of the transmitter substantially. Further the risk of fighting more than the intended target decreases when the light beam is only lit when the ammunition passes the target.

In one preferred embodiment of the invention the fire simulation system comprises means for determining the position of at least one target object and controllable steering means arranged to steer the direction of the simulation axis toward the target.

In a preferred embodiment, the fire simulation system is arranged to continuously update the geographical position, for example by means of a satellite based positioning system such as GPS, of the weapon and of potential targets within a target area for the weapon. In one example, the geographical positions are updated with a first predetermined frequency when a weapon simulation is not executing a simulation and with a second, higher, frequency during fire simulation. The precise knowledge of the positions of the weapon and target objects during simulation provides for high accuracy in the simulations.

In order to further increase the precision of the simulation, the weapon is provided with an orientation sensor arranged to sense the aiming of the weapon. When the aiming of the weapon is known, it is possible to define the target area for the weapon with high accuracy using the aiming information and knowledge of the weapon.

According to one embodiment, the fire simulation system is either partly or entirely disposed at the weapon.

A weapon effect simulation according to one embodiment of the invention comprises the fire simulation system described above and at least one hit simulation system provided on each target object, said hit simulation system including means arranged to receive the emitted light beam and means arranged to determine whether the corresponding target object has been hit based on the value coded in the light beam.

In accordance with one embodiment at least one of the hit simulation systems comprises a transmitter, and the fire simulation system comprises a receiver arranged so as to receive information from the transmitter of the hit simulation system. The transmitter of the hit simulation system can be arranged so as to transmit a hit message upon determination of a hit. Upon reception of a hit message, the control unit is in one preferred embodiment of the invention arranged so as to break off the simulation.

In yet another embodiment of the invention the means arranged to determine hit are arranged so as to determine the hit location on the target.

In summary, the system according to the invention and the method according to the invention offer numerous advantages. First, the ammunition can be simulated with great precision. The high precision is achieved because hit points for the simulated ammunition are based solely on the calculated trajectory of the real ammunition and knowledge of the position of the target. No reflectors are needed in the target, since information about the location of the target object in relation to the light beam is derived from the information in the light beam. In addition, the ammunition can be allowed to be guided or corrected after firing, making it possible to simulate a larger number of weapon types than before.

PREFERRED EMBODIMENTS

Figure 1:
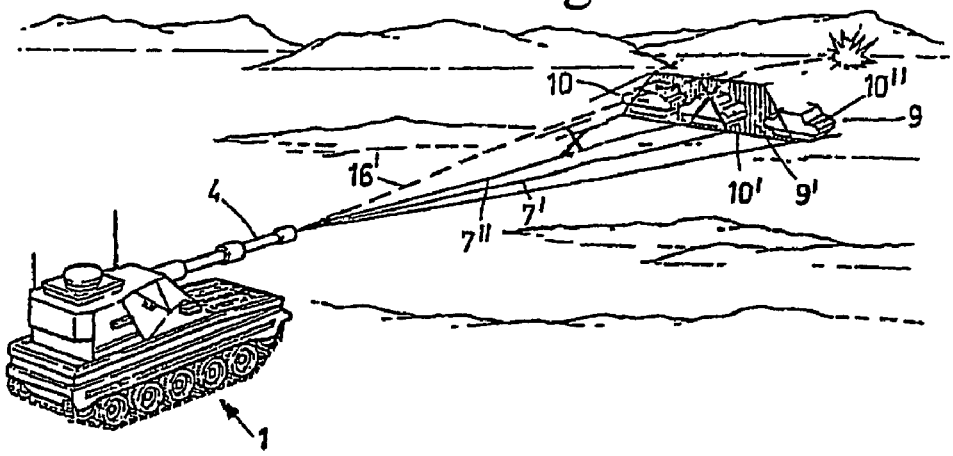
FIG. 1 shows an example of an application of the invention for firing practice.

A conventional weapon, which consists in the example according to FIG. 1 of a gun on a tank 1, can be used as a weapon system in simulated firing practice, wherein the weapon system 10 comprises the gun and a simulation system disposed at the gun.

Figure 2:
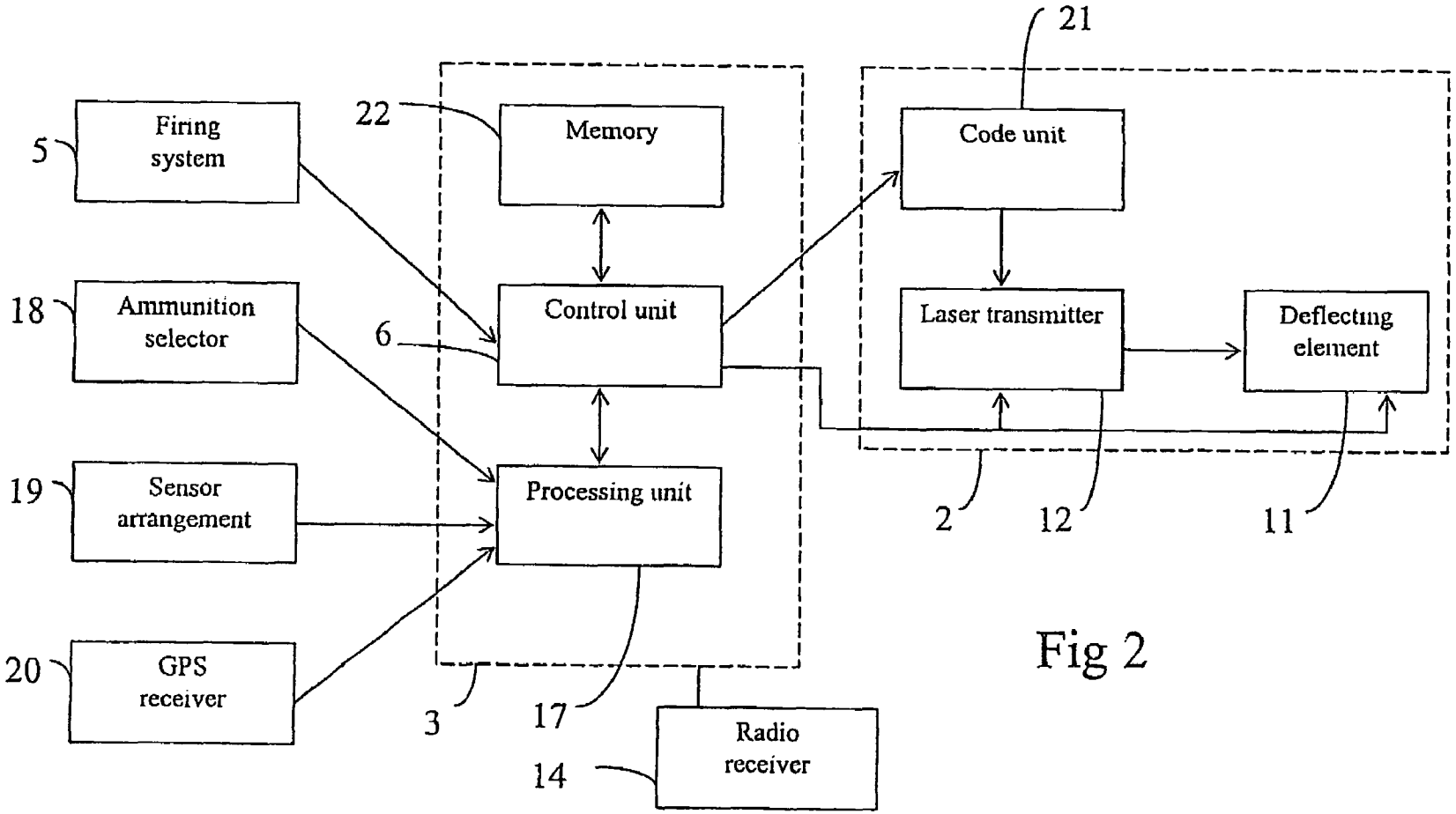
FIG. 2 shows a block diagram of the simulation equipment contained in the tank depicted in FIG. 1 according to one embodiment.

In FIG. 2, the simulation system comprises a transmitter device 2 disposed in connection with the gun, suitably in the barrel 4 of the gun, and a simulator unit 3. The simulator unit 3 is connected with a firing system 5 for the gun, an ammunition selector 18 for selecting the ammunition type, a sensor arrangement 19 to determine, among other things, the motion status of the weapon, and a GPS receiver 20 that receives the geographical position of the simulator unit 3. According to one embodiment, the GPS receiver is supplemented with a radio receiver for receiving a correcting signal, so-called DGPS. The simulator unit 3 is also connected to a receiver 14, for example a radio receiver.

The weapon is aimed and fired as though a real round were being fired, and each time the gunner fires the weapon, the simulator unit 3 is activated. The simulator unit 3 contains a memory 22 arranged so as to store an identity that is unique for the tank 1. Targets 10, 10' and 10" also each have a unique identity stored in a memory 31 (FIG. 4) belonging to each respective target. The tank 1 constantly receives geographical position information via the GPS receiver 20. The targets 10, 10' and 10" also possess knowledge regarding their current geographical positions via a GPS receiver 32 disposed at each respective target. According to one embodiment, the GPS receiver 32 is supplemented with a radio receiver for receiving a correcting signal, so-called DGPS. Each target is arranged so as to broadcast information about its position together with information about its identity via a radio transmitter 26 and the receiver 14 of the weapon system is arranged to continuously receive said information.

Figure 3:
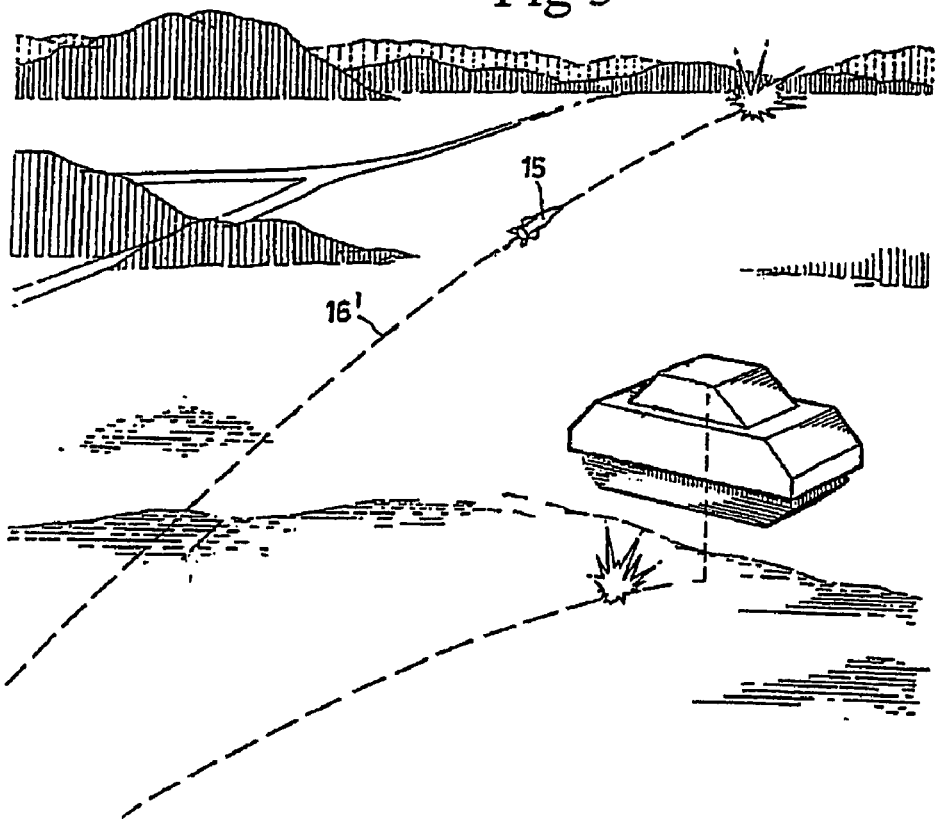
FIG. 3. shows the application in FIG. 1 with the imagined trajectory of a simulated round of ammunition marked.

In FIG. 3, an imagined trajectory 16' of an ammunition 15 is generated in that, upon firing of the weapon, a processing unit 17 that works together with the control unit 6 is initiated to generate a signal that reproduces the trajectory 16' of the ammunition 15, taking into account such factors as will affect the trajectory before, after and at the instant of firing. Factors that are of interest before firing include the type of ammunition, which is selected in view of the target to be attacked. In the illustrative example, the gunner indicates the selected ammunition type by setting the ammunition selector 18, which is operatively connected with the processing unit 17. Other factors that affect the ammunition trajectory are the alignment of the weapon and its motion status at the instant of firing. These parameters are supplied from the sensor arrangement 19, which is operatively connected with the processing unit. For example, the sensor arrangement 19 is equipped with a gyro by means of which the motion status of the weapon is detected. The influence of the atmosphere can affect the imagined ammunition trajectory both stochastically and as calculated based on known conditions from actual cases; such examples can include wind and air temperature. If the imagined ammunition is of a type that is guided after firing, then the guidance signals associated therewith are also included among the factors that can affect the imagined ammunition trajectory. The processing unit 17 generates a signal that is determined relative to the gun and represents the imagined ammunition trajectory 16.

The processing unit 17 is arranged to continuously determine a first distance between the gun and each target 10, 10',10" and to determine a second distance between the gun and the momentary position of the imagined ammunition along the trajectory in real time. In a simple example, the first distance is calculated by comparing the geographical positions received by GPS. In an extended example, the processing unit is arranged to calculate the positions of the gun and targets based on the GPS positions but also on measured accelerations etc and thereafter calculate the first distance.

In one example, the processing unit 17 is arranged so as to calculate the ammunition trajectory in real time, whereupon the most recently calculated value is used for determinating the second distance. Alternatively, the entire ammunition trajectory is calculated upon the firing of a simulated round, whereupon the values at the calculation points are output in real time in order to be used in determination of the second distance. The processing unit 17 is arranged to continuously monitor the first distance for each target to the second distance. When the first and second distances coincide for one of the targets, that target is selected. The processor unit 17 is then arranged to determine a line of sight, or initial simulation axis based on the position of the selected vehicle, known from the receiver 14, and the position of the gun, known from the GPS-receiver 20. The processing unit 17 determines the line of sight as a simulation axis and calculates the perpendicular distance between the simulation axis and the momentary position of the ammunition along the trajectory.

The information regarding the perpendicular distance is fed via the control unit 6 to a code unit 21 in the transmitter device 2. In the code unit 21, the information regarding the perpendicular distance is converted into series of pulses and pauses by means of which the lobes 7' and 7" of the laser transmitter are modulated in a manner that is known per se. The control unit 6 is further arranged so as to control a laser transmitter 12 and a deflecting element 11 so that the coded laser lobes 7' and 7" illuminate the target along the simulation axes during a predetermined time period.

In an extended example, the laser lobes 7' and 7" are caused to rapidly and periodically scan an area at the selected vehicle during the predetermined time interval. This is achieved in a known way via the deflecting elements 11 that are arranged in the beam path of the laser transmitter 12. The deflecting elements 11, realized in the form of e.g. mutually movable optical wedges, are controlled by means of signals from the control unit 6 so that each lobe executes a forward- and backward-moving linear sweep movement with a predetermined speed and direction of movement within a predetermined solid angle area whose cross-section in FIG. 1. is designated 9', and which is suitably centered relative to the barrel. However, the processing unit is arranged to provide to the code unit a new distance value for the perpendicular distance between the laser radiation and the momentary position of the ammunition along the trajectory for each direction of the sweep. Thus, a number of simulation axes are determined and a unique distance value is calculated for each determined simulation axes.

Figure 4:
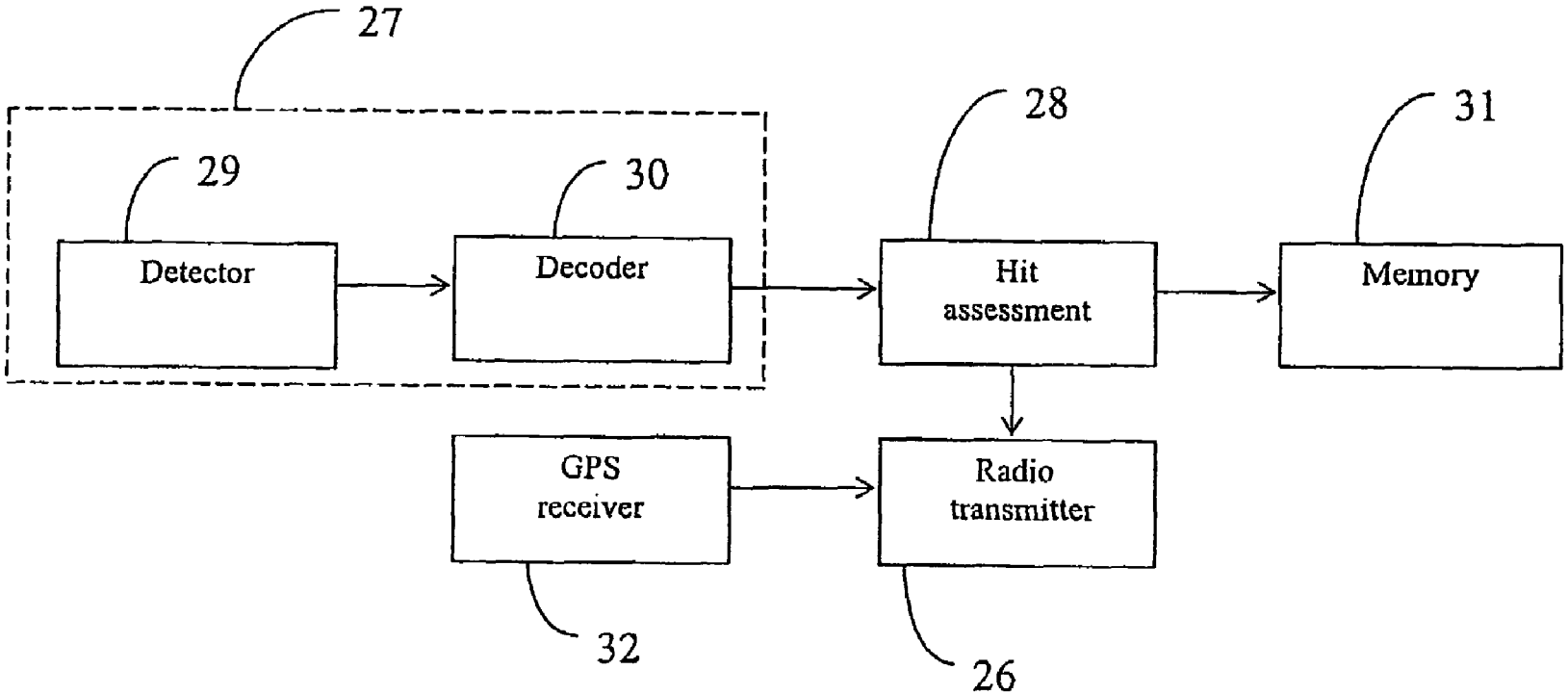
FIG. 4 shows a block diagram of equipment contained in a target depicted in FIG. 1 according to one embodiment.

In FIG. 4, a target system at each target 10, 10' and 10" comprises a receiver unit 27 comprising one or more laser radiation-sensitive detectors 29 and a decoder 30. The fields of view of the detectors should be such that radiation can be detected in all occurring directions of fire as long as the target on which the detectors 29 are disposed is not concealed. The information-bearing modulated radiation that is received by the detectors 29 is converted into an electrical signal, which is fed to the decoder 30 for conversion into a form that is suitable for continued signal processing in a hit assessment unit 28. During the hit assessment, a hit location for the ammunition is first calculated. In this calculation, the orientation of the target is determined and a hit point is determined based on the decoded distance, the hit location of the laser radiation and the determined orientation of the target. The orientation can be determined based on, e.g. the direction obtained from the GPS receiver or knowledge as to which detectors have been illuminated.

A vulnerability calculation is then performed to calculate the effect that a real round of ammunition would have had on the target if it had followed the same trajectory as the imagined ammunition. The calculation is based on, e.g. a predefined division of the target into different vulnerability fields, and translation of the above-calculated hit point into a field number. A hit within a specified field yields a specific effect, e.g. if a hit to the tank track results in a break in the track, causing the tank to become immobile, the soldiers inside the tank can continue to be combat-capable.

Based on the hit assessment, the hit assessment unit 28 generates a message and supplies that message to the radio transmitter 26, which transmits the message. The message can include, e.g. information about the identity of the target, the identity of the weapon that caused the damage, the ammunition type/ammunition identity, and the degree of damage inflicted on the target. During use in a military exercise, the message is received by a central unit that receives status messages from all the actors involved in the exercise that have a separate identity, such as people, weapons, vehicles, etc. In one example the radio receiver 14 of the tank is arranged so as to receive the status messages, and the control unit 6 is arranged so as to break off the simulation of the ammunition 15 upon receiving a message that the ammunition 15 has hit. As previously described, the target system also contains a GPS receiver 25 operatively connected to the transmitter 26 arranged to broadcast position data for the target.

Figure 5:
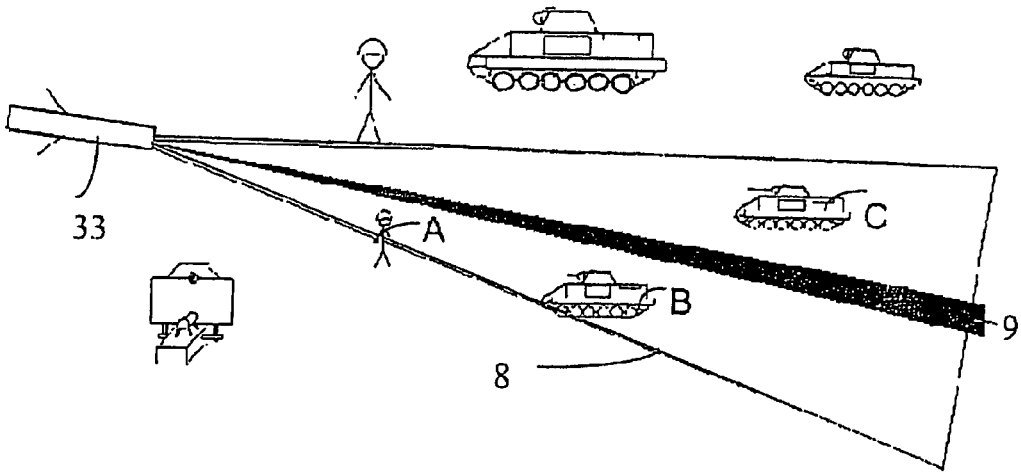
FIGS. 5 and 6 show schematically the concepts of the invention.

FIG. 5 shows the weapon system 33 in relation to a number of potential targets. Only targets A, B and C are within the target area 8 for the weapon and thus only targets A, B and C can be affected by the simulation. The target area 8 can be determined by the GPS-positions of the weapon and potential targets and data from an orientation sensor of the sensor arrangement 19 of the weapon, said orientation sensor describing the aiming of the weapon. The orientation sensor is for example a compass of some kind, such as a magnetic, north seeking gyro or a double GPS. The size of the target area 8 is determined by the accuracy of the GPS information, the performance of the orientation sensor and the updating frequency of the position information for the weapon and potential targets. The sweeping area defined by the lobe 9 is much narrower than the target area. When the simulated ammunition reaches the distance A the transmitter device is arranged to perform the sweeping movement within the lobe 9 and directed towards the target A. When the simulated ammunition reaches the distance for B, the transmitter device is arranged to perform the sweeping movement within the lobe 9 and directed towards the target B. When the simulated ammunition reaches the distance for C, the transmitter device is arranged to perform the sweeping movement within the lobe 9 and directed towards the target C. The sweeping area defined by the lobe 9 is dependent on the size of the targets in relation to the number of detectors mounted on the targets. For example, for a huge target having detectors on only small region(s) thereof, a broad sweeping lobe 9 is required in order to secure that the laser radiation hit the detector(s). On the other hand for a small target covered with detectors only one laser beam is required.

Figure 6:
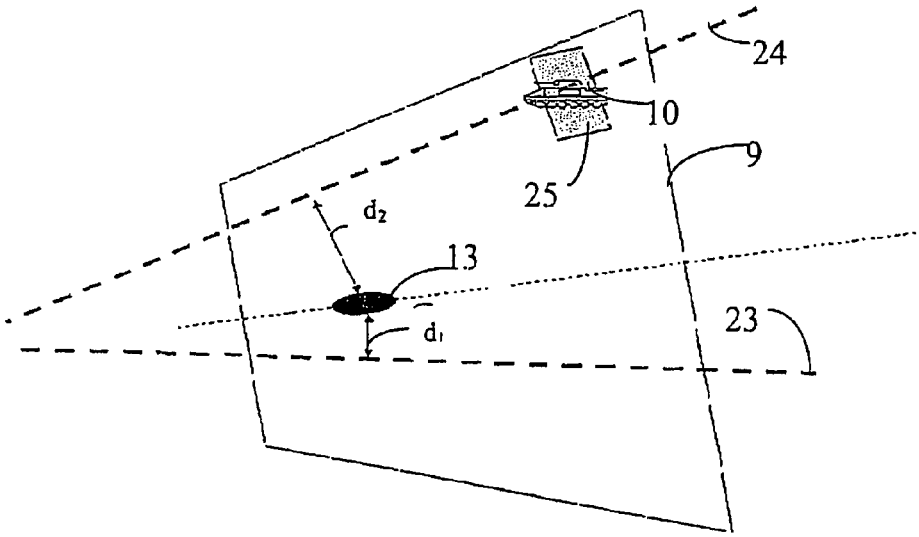

In FIG. 6, axes 23 depicts a first simulation axis in the sweep and axes 24 depicts a second simulation axis in the sweep. It is to be understood that this example is for illustrative purposes only. In reality, the sweep contains a large number of simulation axes. For each simulation axes, the laser radiation is coded with a distance value indicating the perpendicular distance to the momentary position of the ammunition 13 along its trajectory. The laser beam along axes 23 is coded with the distance value $d_1$ while the laser beam along axes 24 is coded with the distance value $d_2$. The distance values $d_1$, $d_2$ are to be understood to include information regarding both the distance to the ammunition and the direction to the ammunition.

In the example of FIG. 6, the laser radiation transmitted along the axis 24 reaches the target. The target is then arranged to perform hit evaluation, as described above, based on the information coded in the laser beam and a target template 25.

Figure 7:
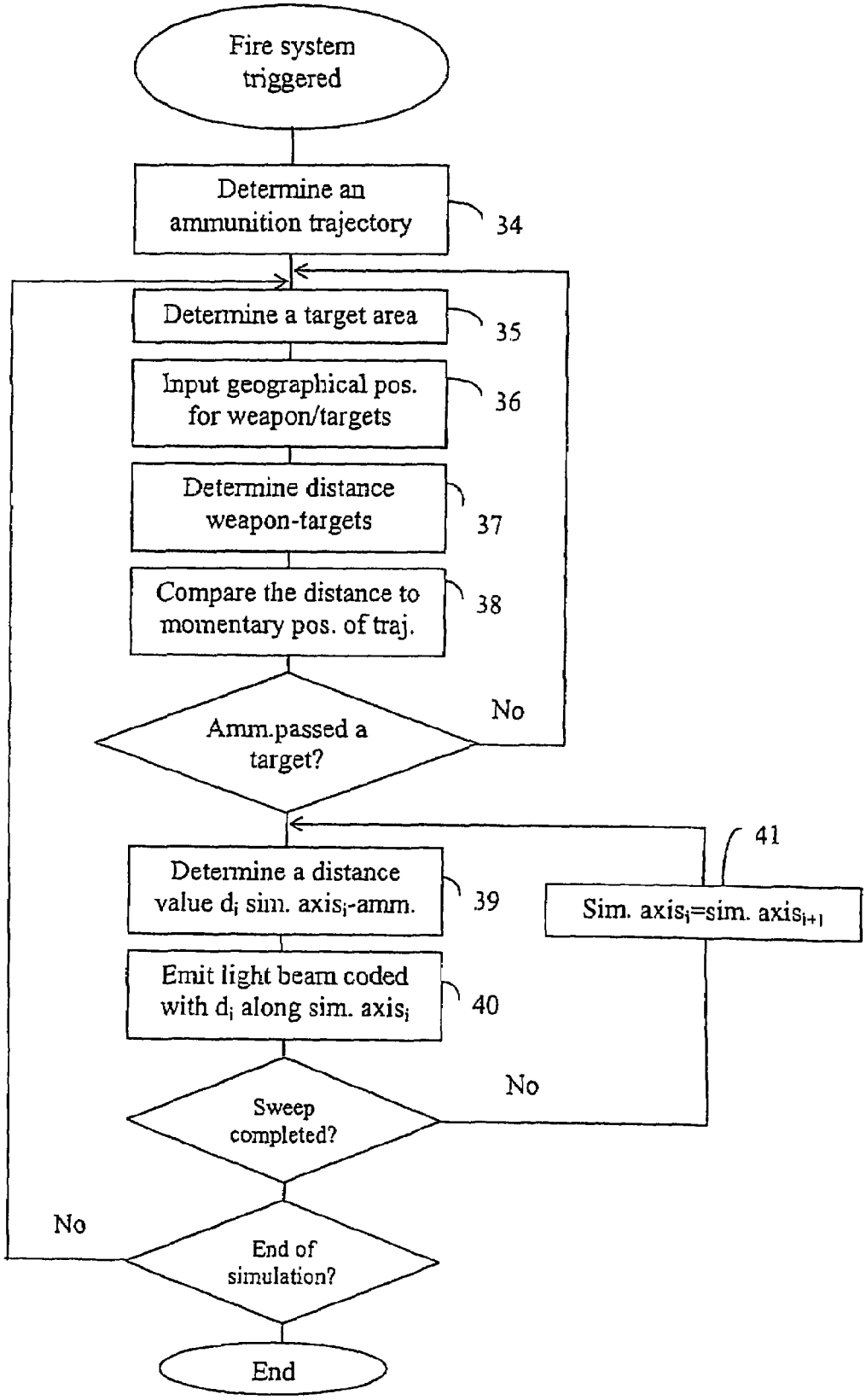
FIG. 7 shows a flow chart over a fire simulation method according to one example of the invention.

In FIG. 7, fire simulation simulating fire from a weapon starts when the firing system 5 is triggered. In a first step 34 a trajectory of the simulated ammunition is determined. In a second step 35, the target area 8 is determined. The target area is for example determined based on aiming information from an orientation sensor on the weapon and based on information regarding the range of the weapon for example stored in the memory 22. In a third step 36, the geographical positions of the weapon and targets are inputted. The inputted geographical positions are used in a fourth step 37 to determine a distance between the weapon and each target present within the target area. In a fifth step 38, the distances calculated in the fourth step 37 are compared to a distance to the momentary position of the ammunition along its trajectory. If one of the targets have been passed, i.e. if the distance to the momentary ammunition position exceeds one of the target distances, the simulation proceeds in a sixth step 39 for that selected target. If no target still has been passed, the simulation goes back to the second step 35 in the shown example. In an application where the targets are expected to be moving slowly, the process can go back to the third step 36 instead, and in an application where the targets are expected to be moving even more slowly or be stationary, the simulation process can go back to the fourth step 38. A delay time can be set before the simulation goes back to the second, third or fourth step.

In the sixth step 39, a simulation axis i is determined such that a light beam transmitted along said simulation axis is directed toward the selected target, and a distance value $d_i$ is determined describing the perpendicular distance between the simulation axis i and the momentary ammunition position. In a seventh step 40, a light beam is emitted along the simulation axis i and coded with at least the distance value $d_i$. The light beam is arranged to perform a predefined sweep around an initial simulation axis 0. If the sweep is not completed, a new simulation axis i+1 is determined in accordance with predefined criteria in an eight step 41 and the sixth and seventh steps 39, 40 are repeated until the sweep is completed. In an alternative example, the simulation axises of the whole sweep and corresponding distance values are first determined, and then the determined data is used for deflecting the light beam and coding the light beam in the manner described above.

When a sweep is completed it is determined whether the simulation is to be ended. The simulation is ended for example if an hit message is received or if the ammunition is determined to have hit ground (reached the end of the trajectoria) or if all targets have been passed. If the simulation is not to be ended, the process goes back to the second step 35 but the previously selected target is removed from the simulation.

The invention claimed is:

1. A fire simulation method for simulating ammunition from a weapon, the method comprising:

determining a trajectory of the simulated ammunition with a simulator unit of the weapon, determining a position of at least one target, determining with the simulator unit a point in time when the simulated ammunition passes the target, determining with the simulator unit a value related to the distance between a simulation axis of the simulation unit and a momentary position of the simulated ammunition along the trajectory at that point in time, and emitting a light beam from the simulator unit along the simulation axis, wherein the light beam is coded with the determined value.

2. The fire simulation method according to claim 1, further comprising:

directing the emitted light beam toward said target with the simulator unit.

3. The fire simulation method according to claim 2, wherein determining the position of at least one target object includes determining the geographical position of potential target objects within a target area for the weapon.

4. The fire simulation method according to claim 3, wherein the aiming of the weapon is sensed by the simulator unit and wherein the simulator unit uses the sensed aiming and information about the range of the weapon in determining the target area.

5. The fire simulation method according to claim 1, wherein determining the point in time when the simulated ammunition passes the target object includes determining a first distance between the weapon and each potential target object, and comparing said first distance to a second distance to a momentary position of the simulated ammunition along the trajectory.

6. The fire simulation method according to claim 1, wherein the light beam is caused to execute a sweeping movement during the predetermined time period and wherein for each direction of the sweep a new value corresponding to said direction is determined and coded into the light beam by the simulator unit.

7. A fire simulation system, comprising:

a transmitter arranged to emit a light beam along a simulation axis to simulate ammunition from a weapon, a coding unit configured to code the light beam with information, a position determining unit configured to determine a position of a target object, a processing unit configured to calculate a trajectory of the simulated ammunition, wherein the processing unit is further configured to determine a point in time when the simulated ammunition passes the target object, and a control unit arranged to activate the transmitter for a predetermined time period from said point in time, wherein the control unit is arranged to determine a value related to the distance between the simulation axis and a momentary position of the simulated ammunition along the trajectory at the determined point in time and wherein said coding unit is configured to code said light beam with the determined value.

8. The fire simulation system according to claim 7, further comprising:

a controllable steering unit configured to steer the direction of the simulation axis toward the target object.

9. The fire simulation system according to claim 7, wherein the position determining unit is configured to continuously update the geographical position of the weapon and of potential targets within a target area for the weapon.

10. The fire simulation system according to claim 9, wherein the weapon comprises an orientation sensor arranged to sense the aiming of the weapon and wherein the target area is determined by at least the aiming and the range of the weapon.

11. The fire simulation system according to claim 7, wherein the processing unit is configured to determine a first distance between the weapon and each potential target object and to continuously compare said first distance to a second distance to the momentary position of the ammunition along the trajectory in order to determine the point in time when the ammunition passes a target object.

12. The fire simulation system according to claim 8, wherein said steering unit is configured to cause the light beam to execute a sweeping movement during the predetermined time period and wherein the coding unit is configured to code the light beam for each direction of the sweep with a value representative of said direction.

13. The fire simulation system according to claim 7, wherein said transmitter is a laser transmitter arranged so as to transmit laser radiation with at least one beam lobe.

14. The fire simulation system according to claim 7, wherein the coding unit is configured to code information in the light beam, which information identifies the target object.

15. The fire simulation system according to claim 8, wherein the fire simulation system is disposed at a weapon.

16. A weapon effect simulation system, comprising:

a fire simulation system comprising a transmitter arranged to emit a light beam along a simulation axis to simulate ammunition from a weapon, a coding unit configured to code the light beam with information, a position determining unit configured to determine a position of a target object, a processing unit configured to calculate a trajectory of the simulated ammunition, wherein the processing unit is further configured to determine a point in time when the simulated ammunition passes the target object, and a control unit arranged to activate the transmitter for a predetermined time period from said point in time, wherein the control unit is arranged to determine a value related to the distance between the simulation axis and a momentary position of the simulated ammunition along the trajectory at the determined point in time and wherein said coding unit is configured to code said light beam with the determined value, and at least one hit simulation system provided on each target object, said hit simulation system comprising a receiver configured to receive the emitted light beam and a hit determining unit configured to determine whether the corresponding target object has been hit based on the value coded in the light beam.

17. The weapon effect simulation system according to claim 16, wherein at least one of the hit simulation systems comprises a transmitter, and wherein the fire simulation system further comprises a receiver arranged so as to receive information from the transmitter of the hit simulation system.

18. The weapon effect simulation system according to claim 17, wherein the transmitter is arranged so as to transmit a hit message upon determination of a hit.

19. The weapon effect simulation system according to claim 18, wherein the control unit is arranged so as to break off the simulation upon reception of the hit message.

20. The weapon effect simulation system according to claim 16, wherein the hit determining unit is further configured to determine the hit location on the target.

* * * * *